US008874002B2

(12) United States Patent
Nakagawa

(10) Patent No.: US 8,874,002 B2
(45) Date of Patent: Oct. 28, 2014

(54) BELT DRIVING DEVICE AND IMAGE FORMING APPARATUS INCLUDING BELT DRIVING DEVICE

(71) Applicant: Canon Kabushiki Kaisha, Tokyo (JP)

(72) Inventor: Tomohito Nakagawa, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 20 days.

(21) Appl. No.: 13/652,727

(22) Filed: Oct. 16, 2012

(65) Prior Publication Data

US 2013/0101323 A1 Apr. 25, 2013

(30) Foreign Application Priority Data

Oct. 21, 2011 (JP) ..... 2011-232037

(51) Int. Cl.
*G03G 15/00* (2006.01)
*G03G 15/01* (2006.01)

(52) U.S. Cl.
CPC .... *G03G 15/0189* (2013.01); *G03G 2215/0132* (2013.01); *G03G 15/755* (2013.01); *G03G 2215/00156* (2013.01)
USPC ..... 399/165; 399/302

(58) Field of Classification Search
CPC ..... G03G 2215/00156
USPC ..... 399/165, 302; 250/208.6; 356/498
See application file for complete search history.

(56) References Cited

U.S. PATENT DOCUMENTS

| | | | | |
|---|---|---|---|---|
| 5,347,348 | A * | 9/1994 | Nagata | 399/329 |
| 5,519,230 | A * | 5/1996 | Hubble et al. | 250/559.36 |
| 5,565,965 | A * | 10/1996 | Costanza et al. | 399/167 |
| 5,567,976 | A * | 10/1996 | Dierschke et al. | 257/443 |
| 6,385,430 | B1 * | 5/2002 | Jackson et al. | 399/371 |
| 7,324,212 | B2 * | 1/2008 | Mitchell et al. | 356/499 |
| 7,668,491 | B2 * | 2/2010 | Furuya et al. | 399/302 |
| 8,169,619 | B2 * | 5/2012 | Oberhauser | 356/498 |
| 8,180,273 | B2 * | 5/2012 | Fujihara | 399/395 |
| 8,412,081 | B2 * | 4/2013 | Kudo et al. | 399/302 |

FOREIGN PATENT DOCUMENTS

| | | | |
|---|---|---|---|
| JP | 2006-343629 | A | 12/2006 |
| JP | 2008-26676 | A | 2/2008 |
| JP | 2009-251321 | A | 10/2009 |
| JP | 2010-223981 | A | 10/2010 |
| JP | 2011-128585 | A | 6/2011 |

* cited by examiner

*Primary Examiner* — Clayton E Laballe
*Assistant Examiner* — Leon W Rhodes, Jr.
(74) *Attorney, Agent, or Firm* — Canon USA Inc IP Division

(57) ABSTRACT

A belt member driving device includes an arm configured to be movable with movement of a belt member in a width direction thereof while being in contact with an end of the belt member in the width direction thereof, a first detected portion provided on the arm, a second detected portion provided on the arm and disposed in a position different from that of the first detected portion in a direction perpendicular to a movement direction of the arm on a plane where the arm is moved, a first sensor configured to detect the first detected portion, and a second sensor configured to detect the second detected portion. The second sensor and the first sensor partly overlap each other in the movement direction of the arm as viewed in a direction perpendicular to the movement direction of the arm.

10 Claims, 9 Drawing Sheets

FIG. 6

| POSITION NO. | STATE | | SENSOR | | | | |
|---|---|---|---|---|---|---|---|
| | | | 80a | 80b | 80c | 80d | 80e |
| 0 | REAR SIDE (SECOND SIDE) | ERROR | ○ | ○ | ○ | ○ | ○ |
| 1 | | STOP | ○ | ○ | ○ | ○ | ● |
| 2 | | LARGE | ○ | ○ | ○ | ● | ● |
| 3 | | MIDDLE | ○ | ○ | ● | ● | ● |
| 4 | | SMALL | ○ | ● | ● | ● | ● |
| 5 | FRONT SIDE (FIRST SIDE) | SMALL | ● | ● | ● | ● | ● |
| 6 | | MIDDLE | ● | ● | ● | ● | ○ |
| 7 | | LARGE | ● | ● | ● | ○ | ○ |
| 8 | | STOP | ● | ● | ○ | ○ | ○ |
| 9 | | ERROR | ● | ○ | ○ | ○ | ○ |

BELT DRIVING DEVICE AND IMAGE FORMING APPARATUS INCLUDING BELT DRIVING DEVICE

BACKGROUND OF THE INVENTION

1. Field of the Invention

The present invention relates to a belt driving device that drives a belt member, and an image forming apparatus that includes the belt driving device and forms an image on a recording material.

2. Description of the Related Art

To deal with various recording materials, an image forming apparatus includes a transfer unit that transfers a toner image formed on an image bearing member such as a photosensitive drum to an intermediate transfer member and then transfers the toner image formed on the intermediate transfer member to a recording material.

Japanese Patent Application Laid-Open No. 2008-26676 discusses an apparatus that includes a non-contact distance sensor facing a detected surface integrated with an arm moving in contact with an end of a belt in a width direction thereof to detect a position of the belt travelling in the width direction thereof. However, such a sensor that can continuously detect the position requires higher costs than a sensor such as a photo-interrupter.

Japanese Patent Application Laid-Open No. 2010-223981 discusses a configuration that a roller for stretching an intermediate transfer belt is inclined to suppress deviation of a travelling intermediate transfer belt in a width direction thereof. The inclination amount of the roller is controlled based on a detection result by a detection unit that detects a position of the intermediate transfer belt. An arm that is moved in contact with an end of the intermediate transfer belt in the width direction is disposed to detect the position of the intermediate transfer belt. Further, a plurality of sensors such as photo-interrupters is disposed along a movement locus of the arm to detect a detected portion provided for the arm.

In such a configuration, all the sensors detect the common detected portion, and the sensors are, therefore, arranged adjacent each other. Thus, if an interval between the sensors is to be narrow for fine detection, the sensors hit each other or space necessary for attaching the sensor cannot be reserved. Thus, the arrangement interval between the sensors cannot be narrowed, so that fine detection cannot be realized.

SUMMARY OF THE INVENTION

According to an aspect of the present invention, a belt member driving device includes a movable belt member, a tension roller configured to stretch the belt member, a driving source configured to drive the belt member, a steering roller configured to stretch the belt member and to be able to incline relative to the tension roller to move the belt member being driven in a width direction of the belt member, an arm configured to be movable with movement of the belt member in the width direction thereof while being in contact with an end of the belt member in the width direction thereof, a first detected portion provided on the arm, a second detected portion provided on the arm and disposed in a position different from that of the first detected portion in a direction perpendicular to a movement direction of the arm on a plane where the arm is moved, a first sensor configured to detect the first detected portion, a second sensor configured to detect the second detected portion, wherein the second sensor and the first sensor partly overlap each other in the movement direction of the arm as viewed in a direction perpendicular to the movement direction of the arm, and a control unit configured to control inclination of the steering roller based on detection results by the first sensor and the second sensor.

According to an exemplary embodiment of the present invention, the second detected portion is arranged in the position different from that of the first detected portion in the direction perpendicular to the movement direction of the arm. In the movement direction of the arm, the second sensor can be, therefore, arranged to partly overlap the first sensor. Thus, the detection can be finely performed.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

FIG. 6 illustrates an explanatory diagram of combinations of belt detection positions according to the first exemplary embodiment.

DESCRIPTION OF THE EMBODIMENTS

Various exemplary embodiments, features, and aspects of the invention will be described in detail below with reference to the drawings.

Figure 1:
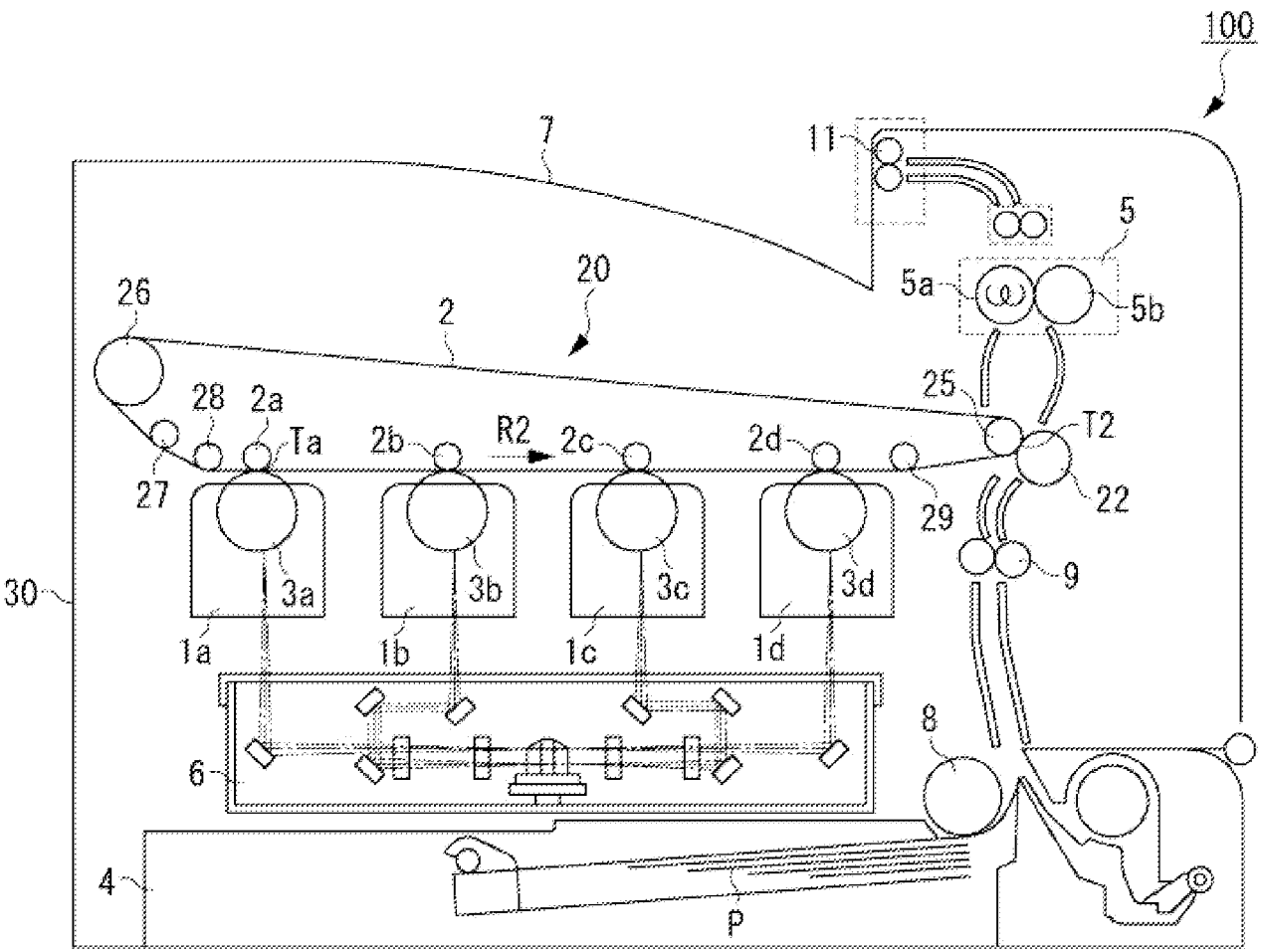
FIG. 1 illustrates an explanatory diagram of a configuration of an image forming apparatus according to a first exemplary embodiment of the present invention.

An image forming apparatus 100 is described according to a first exemplary embodiment of the present invention with reference to FIG. 1.

Image forming units 1*a*, 1*b*, 1*c*, and 1*d* form images. The image forming units 1*a*, 1*b*, 1*c*, and 1*d* form images by using toners of yellow, magenta, cyan, and black. Other than toners, configurations of the image forming units 1*a* to 1*d* are shared. Therefore, the image forming unit 1*a* is described as an example.

The image forming unit 1*a* is assembled as a replaceable unit (process cartridge). The image forming unit 1*a* includes a photosensitive drum 3*a* as an image bearing member. The photosensitive drum 3*a* is rotated at a predetermined process speed. The photosensitive drum 3*a* is charged to uniform negative potentials by a charge roller that charges the photosensitive drum 3*a*. The surface of the charged photosensitive drum 3*a* is exposed by an exposure device 6. The exposure device 6 exposes the photosensitive drum 3*a* by using laser beams ON/OFF-modulated according to image data, thereby forming an electrostatic latent image on the photosensitive drum 3*a*. A developing device that develops the toner image of yellow develops the electrostatic image as the toner image of yellow on the photosensitive drum 3*a*. A primary transfer roller 2*a* presses the intermediate transfer belt 2, to which the toner image is transferred, thereby forming a primary transfer portion Ta, where the toner image is transferred to the intermediate transfer belt 2 from the photosensitive drum 3*a*. A positive direct-current voltage is applied to the primary transfer roller 2*a*. As a consequence, at the primary transfer portion Ta, a negative toner image borne on the photosensitive drum 3*a* is transferred to the intermediate transfer belt 2.

The image forming units 1*b*, 1*c*, and 1*d* similarly form the toner images of magenta, cyan, and black on corresponding photosensitive members 3*b*, 3*c*, and 3*d*. Further, corresponding primary transfer rollers 2*b*, 2*c*, and 2*d* similarly transfer the toner images formed on the photosensitive members 3*b*, 3*c*, and 3*d* to the intermediate transfer belt 2. When forming a color image, the image forming units 1*b* to 1*d* perform image formation operations for overlapping the toner images with different colors on the intermediate transfer belt 2.

The intermediate transfer belt 2 is an endless belt member including a base material containing polyimide. The intermediate transfer belt 2 is stretched by a tension roller 27 that keeps tension of the intermediate transfer belt 2, a driving roller 26 that drives the intermediate transfer belt 2, a secondary-transfer inside roller 25, and tension rollers 28 and 29. Further, the intermediate transfer belt 2 is movable by the driving roller 26 in a direction of an arrow R2. The tension roller 27, which is arranged between the tension roller 28 and the driving roller 26, presses the intermediate transfer belt 2 towards the outside, thereby applying tension of 30 N (3 kgf) to the intermediate transfer belt 2. An angle at which the driving roller 26 is wound around the intermediate transfer belt 2 is set to at least 90 degrees or more. As a consequence, the driving roller 26 cannot be slippery on the intermediate transfer belt 2.

A draw-out roller 8 draws out a recording material P one by one from a recording material cassette 4, and a registration roller 9 carries the recording material P to a secondary transfer portion T2, where the toner image is transferred thereto. The registration roller 9 sends the recording material P to the secondary transfer portion T2 at a timing when the toner image on the intermediate transfer belt 2 reaches the secondary transfer portion T2.

A secondary-transfer outside roller 22 comes into contact with the intermediate transfer belt 2, thereby forming the secondary transfer portion T2, where the toner image is transferred to the recording material P. The secondary-transfer inside roller 25 is arranged opposite the position of the secondary-transfer outside roller 22, to sandwich the intermediate transfer belt 2. A positive direct-current voltage is applied to the roller secondary-transfer outside 22 from a power source (not illustrated). The secondary-transfer inside roller 25 is grounded. As a consequence, a transfer electrical field for transferring the toner image is generated between the secondary-transfer inside roller 25 and the secondary-transfer outside roller 22. At the secondary transfer portion T2, the toner image is transferred to the recording material P.

The recording material P to which the toner image is transferred is conveyed to a fixing device 5 that fixes the toner image. The fixing device 5 forms a fixing nip portion including a fixing roller 5*a* with a heater and a pressing roller 5*b*. The recording material P is nipped by the fixing nip portion, and the toner image is thus dissolved with heat and pressure. The toner image is thus fixed to the recording material P.

The moving intermediate transfer belt 2 can be deviated in a direction vertical to a movement direction of the intermediate transfer belt 2. Therefore, it is desirable to provide a steering device that steers the intermediate transfer belt 2 in a width direction thereof in order to suppress the deviation in the width direction of the intermediate transfer belt 2. According to the present exemplary embodiment, an intermediate transfer unit 20 including the intermediate transfer belt 2 is configured to enable the driving roller 26 to function as a steering roller.

Figure 2:
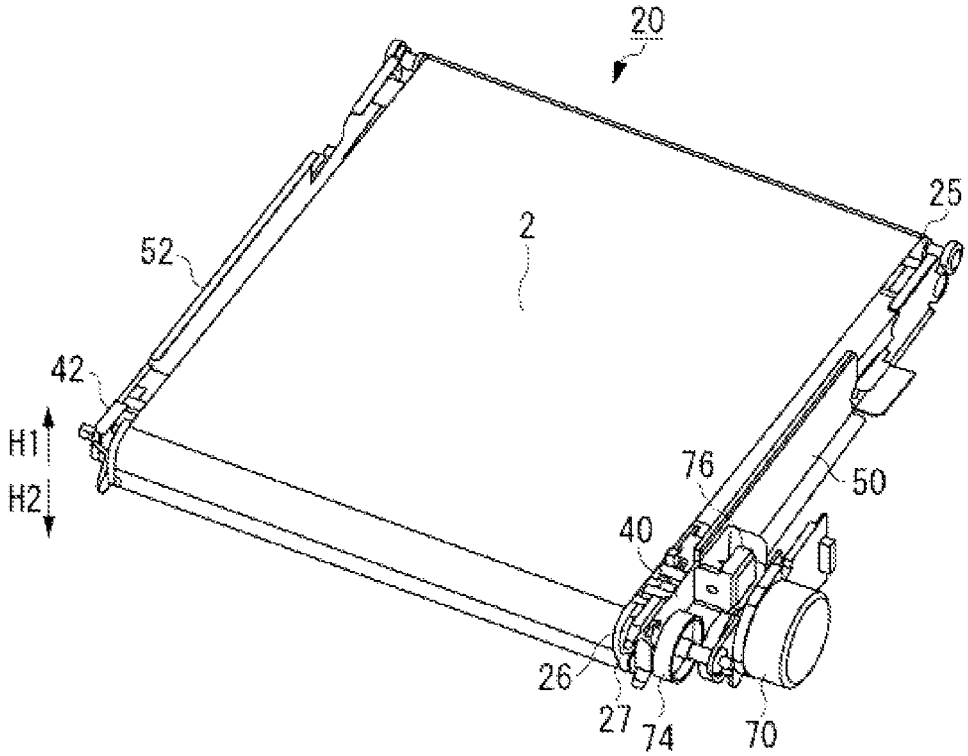
FIG. 2 illustrates a perspective view of an intermediate transfer unit according to the first exemplary embodiment.
Figure 3:
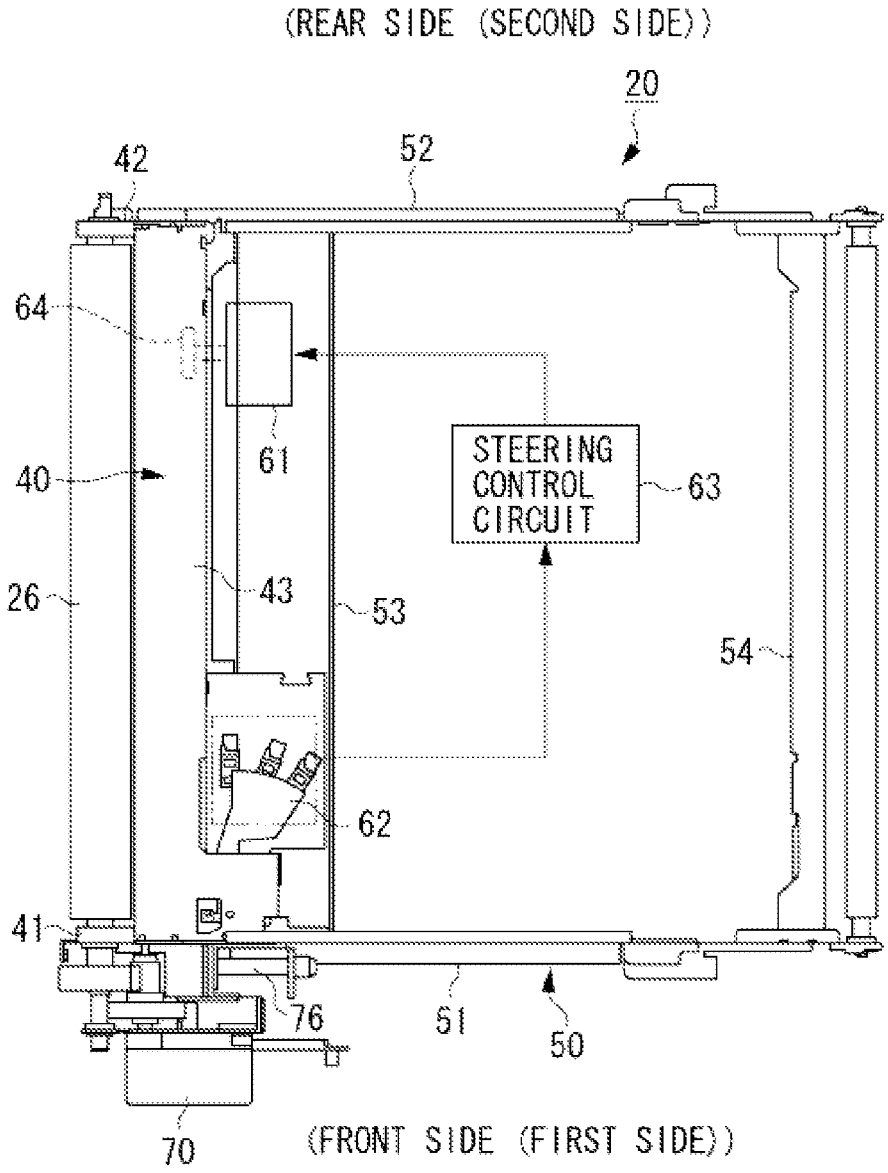
FIG. 3 illustrates an explanatory diagram of a planar arrangement of a first frame and a second frame according to the first exemplary embodiment.

The intermediate transfer unit 20 including the intermediate transfer belt 2 is described with reference to FIGS. 2 and 3. The intermediate transfer unit 20 is a replaceable unit, and is arranged above the image forming units 1*a*, 1*b*, 1*c*, and 1*d*. Further, the intermediate transfer unit 20 includes a first frame 50 that supports the secondary-transfer inside roller 25, the primary transfer rollers 2*a*, 2*b*, 2*c*, and 2*d*, and the tension rollers 28 and 29, and a second frame 40 that supports the driving roller 26 and the tension roller 27. On the front side of the second frame 40 in a width direction thereof, a driving motor 70 is arranged as a driving source for supplying driving force to the driving roller 26.

The first frame 50 includes a side plate 51 arranged on a front side (first side) in a width direction thereof, a side plate 52 arranged on a rear side (second side) in the width direction, and beam plates 53 and 54 that connect the side plate 51 with the side plate 52.

The second frame 40 includes a side plate 41 arranged on the first side in a width direction thereof, a side plate 42 arranged on the second side thereof, and a beam plate 43 that connects the side plate 41 with the side plate 42. The beam plates 53, 54, and 43 provide rigidity required for a steering operation to the first and second frames 50 and 40.

A rotary shaft 76 rotates the side plate 41 of the second frame 40. The second frame 40 is supported by the first frame 50 on the first side via the rotary shaft 76. On the second side, the position of the second frame 40 is not fixed. That is, on the second side, the second frame 40 is moved in a direction H1 or a direction H2 opposite to the direction H1, and is thus inclined relative to the first frame 50.

The second frame 40 includes gears 74 and 75 that transmit the driving force from the driving motor 70 to the driving roller 26. Therefore, even if the second frame 40 is inclined, a positional relationship between the driving motor 70, the gears 74 and 75, and the driving roller 26 is not changed. Thus, unstable rotation of the driving roller 26 is suppressed even when the second frame 40 is inclined.

The driving motor 70 is arranged on the rotary shaft 76 on the opposite side of the driving roller 26 in the width direction. As a result, a direction of rotational moment generated in the second frame 40 with self weight of the driving motor 70 is opposite to that of rotational moment generated in the second frame 40 with self weight of the driving roller 26. Thus, a position of the second frame 40 is easily stable.

Further, an eccentric cam 64 that comes into contact with the beam plate 43 is arranged near the side plate 42 in the width direction. A steering motor 61 is a driving source that is arranged on the beam plate 53 of the first frame 50 and drives the eccentric cam 64.

When the steering motor 61 drives the eccentric cam 64, the beam plate 42 of the second frame 40 is moved. As a consequence, the driving roller 26 is inclined.

A position of the first frame 50 to which the steering motor 61 is arranged is fixed to the device body. Therefore, the steering motor 61 is stably driven.

A control circuit 63 functions as a steering control unit that controls the steering motor 61. The control circuit 63 receives positional information from a belt position detection device 110 that detects a position of the intermediate transfer belt 2 in the width direction. The control circuit 63 moves the steering motor 61 based on the positional information from the belt position detection device 110. Thus, alignment of the steering roller 26 is changed, thereby correcting the deviation of the intermediate transfer belt 2. The details of the belt position detection device 110 are described below.

Figure 4A:
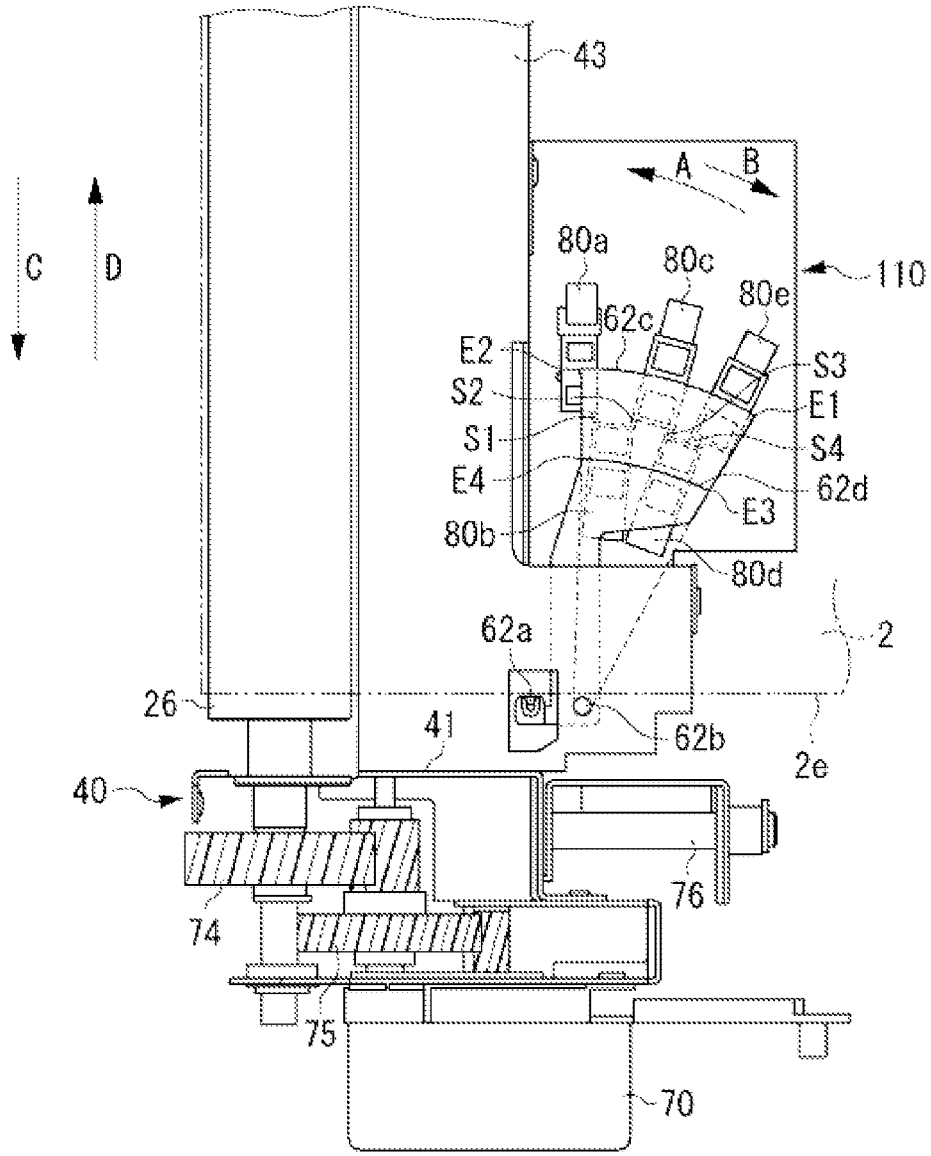
FIGS. 4A and 4B illustrate explanatory diagrams of a driving mechanism of a driving roller according to the first exemplary embodiment.
Figure 4B:
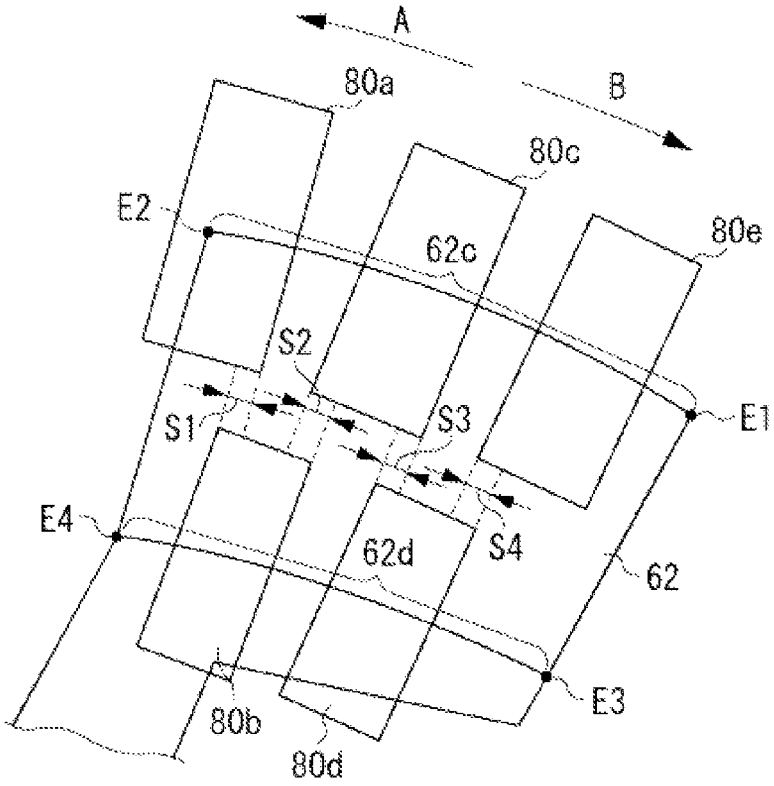
Figure 5:
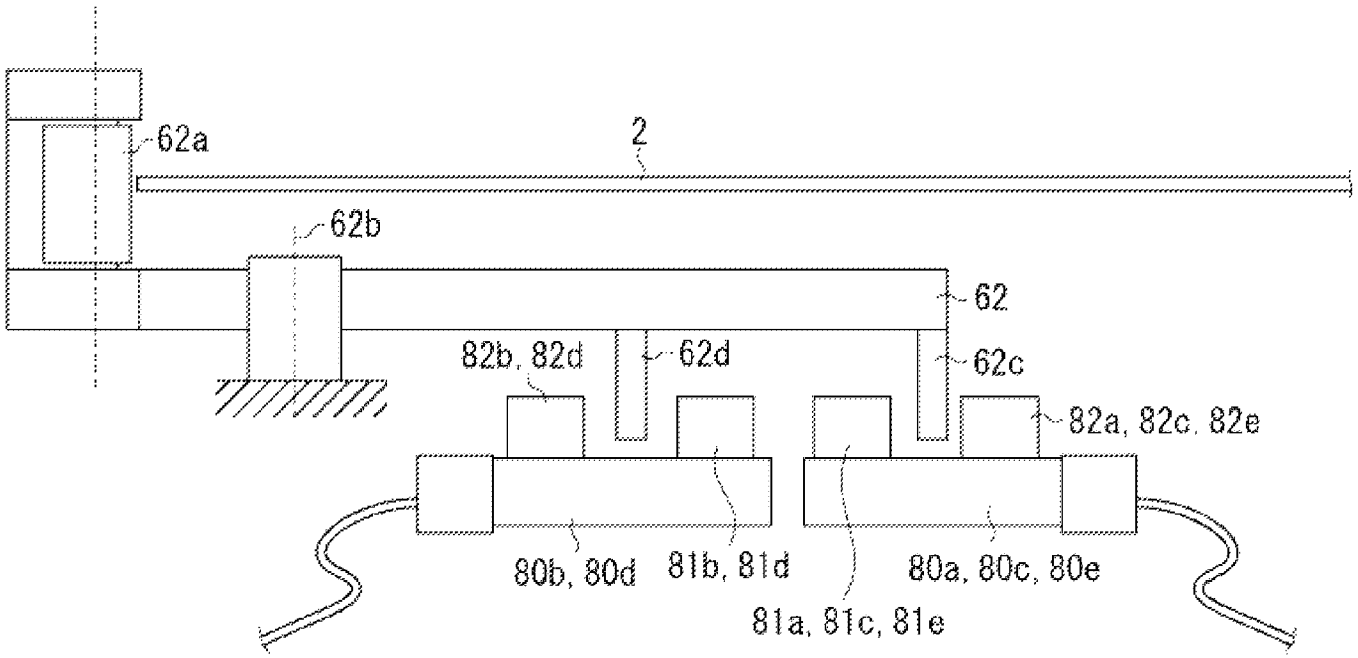
FIG. 5 illustrates an explanatory diagram of a belt detection device according to the first exemplary embodiment.

According to the present exemplary embodiment, the steering motor 61 is controlled based on a detection result by the belt position detection device 110. The details of a configuration of the belt position detection device 110 according to the present exemplary embodiment are described with reference to FIGS. 4A and 4B.

An arm 62 is rotatable around a rotary center 62*b* in a circumferential direction thereof. The arm 62 includes a contact roller 62*a* functioning as a contact unit that comes into contact with an end of the intermediate transfer belt 2 in the width direction. When the contact roller 62*a* comes into contact with the end of the intermediate transfer belt 2, the arm 62 follows movement of the intermediate transfer belt 2 in the width direction and is thus rotated around the rotary center 62*b* in the circumferential direction. When the intermediate transfer belt 2 is moved in a direction C in the width direction, the arm 62 is rotated in a direction A in the circumferential direction. When the intermediate transfer belt 2 is moved in a direction D in the width direction, the arm 62 is rotated in a direction B in the circumferential direction.

Further, the arm 62 includes a projection 62*c* to be projected to the rotary center 62*b* on a side that is opposite to the contact roller 62*a* and that does not face a rear surface of the intermediate transfer belt 2. To detect the projection 62*c*, photosensors 80*a*, 80*c*, and 80*e* are arranged along a locus where the projection 62*c* is moved when the arm 62 is rotated in the circumferential direction. That is, the photosensors 80*a*, 80*c*, and 80*e* are arranged in the same position in a radial direction vertical to the circumferential direction in which the arm 62 is rotated, and are arranged in different positions in the circumferential direction in which the arm 62 is rotated. The photosensors 80*a*, 80*c*, and 80*e* are those integrated with light emission and light reception, including light emission units 81*a*, 81*c*, and 81*e* that emit light and light reception units 82*a*, 82*c*, and 82*e* that receive light from the light emission units 81*a*, 81*c*, and 81*e*. Thus, each of the photosensors 80*a*, 80*c*, and 80*e* includes a single detection unit. Light from the light emission units 81*a*, 81*c*, and 81*e* is constantly turned on. Therefore, when the projection 62*c* on the arm 62 passes through the photosensors 80*a*, 80*c*, and 80*e*, the projection 62*c* blocks the light from the light emission units 81*a*, 81*c*, and 81*e*, and the light does not reach the light reception units 82*a*, 82*c*, and 82*e* (which is in the off-state). On the other hand, when the projection 62*c* on the arm 62 does not pass through the photosensors 80*a*, 80*c*, and 80*e*, the projection 62*c* does not block the light from the light emission units 81*a*, 81*c*, and 81*e*, and the light reaches the light reception units 82*a*, 82*c*, and 82*e* (which is in the on-state). In other words, the projection 62*c* functions a detected portion (first detected portion) detected by the photosensors 80*a*, 80*c*, and 80*e*. Combination of the on-state and the off-state of the photosensors 80*a*, 80*c*, and 80*e* is changed depending on the position of the arm 62. When the arm 62 is moved in the direction A in FIG. 4B, the photosensors 80*e*, 80*c*, and 80*a* are sequentially switched on in order thereof. Based on the combination of the on-state and the off-state of the photosensors 80*a*, 80*c*, and 80*e*, the position of the intermediate transfer belt 2 can be detected in real time.

For fine detection of the position of the intermediate transfer belt 2, an interval between the photosensors 80*a*, 80*c*, and 80*e* can be narrowed in the movement direction of the arm 62. However, the photosensors 80*a*, 80*c*, and 80*e* are arranged along the locus of the common projection 62*c* formed with the movement of the arm 62. Therefore, if the interval between the photosensors 80*a*, 80*c*, and 80*e* in the movement direction of the arm 62 is tried to be narrowed, there is a possibility that space necessary for arranging an arrangement tool of the photosensors 80*a*, 80*c*, and 80*e* cannot be reserved. Also, an arrangement interval between the photosensors 80*a*, 80*c*, and 80*e* can be limited depending on the size of an external shape of the photosensor 80*a*, 80*c*, or 80*e* in the movement direction of the arm 62. Thus, the arrangement interval between the photosensors 80*a*, 80*c*, and 80*e* cannot be narrowed and the fine detection cannot be performed.

According to the present exemplary embodiment, a projection 62*d* is arranged in a position different from that of the projection 62*c* in a radial direction vertical to the circumferential direction in which the arm 62 is rotated. Further, as a photosensor that detects the projection 62*d*, photosensors 80*b* and 80*d* are arranged along a movement locus of the projection 62*d*. That is, the photosensors 80*b* and 80*d* are arranged in the same position in the radial direction vertical to the circumferential direction in which the arm 62 is rotated, and are arranged in different positions in the circumferential direction in which the arm 62 is rotated. Furthermore, the photosensor 80*b* is arranged between the photosensors 80*a* and 80*c* in the circumferential direction in which the arm 62 is rotated. In addition, the photosensor 80*d* is arranged between the photosensors 80*c* and 80*e* in the circumferential direction in which the arm 62 is rotated.

Thus, with the configuration including the arm 62 that is moved in contact with the end of the intermediate transfer belt 2 to determine the position of the intermediate transfer belt 2 in the width direction and a plurality of photosensors 80*a* to 80*e* that detect the position of the arm 62, the arrangement interval between the photosensors 80*a* to 80*e* can be narrowed in the movement direction of the arm 62.

For a period between a time when the photosensor 80*a* detects the projection 62*c* and a time when the photosensor 80*c* detects the projection 62*c*, the photosensor 80*b* detects the projection 62*d*. For a period between a time when the photosensor 80*c* detects the projection 62*c* and a time when the photosensor 80*e* detects the projection 62*c*, the photosensor 80*d* detects the projection 62*d*. That is, the projections 62*c* and 62*d* are alternately detected and the detection thus becomes fine.

The photosensors 80*b* and 80*d* have a similar configuration to those of the photosensors 80*a*, 80*c*, and 80*e*. The photosensors 80*b* and 80*d* respectively include light emission units 81*b* and 81*d* and light reception units 82*b* and 82*d*. The projection 62*d* functions as a detected portion (second detected portion) that is detected by the photosensors 80*b* and 80*d*.

In the circumferential direction in which the arm 62 is rotated, the photosensors 80*a*, 80*b*, 80*c*, 80*d*, and 80*e* are arranged at an equal interval. This is because the position of the intermediate transfer belt 2 in the width direction is detected at an equal interval.

As viewed from the rotational center 62*b*, the projection 62*d* overlaps the projection 62*c*. Thus, a shadow of the projection 62*d* projected in the radial direction overlaps a shadow of the projection 62*c* in the radial direction. That is, on a line that connects one end E1 of the projection 62*c* in the movement direction of the arm 62 to the rotational center 62*b*, one end E3 of the projection 62*d* in the movement direction of the arm 62 is positioned. On a line that connects another end E2 of the projection 62*c* in the movement direction of the arm 62 to the rotational center 62*b*, another end E4 of the projection 62*d* in the movement direction of the arm 62 is positioned.

According to the present exemplary embodiment, in the circumferential direction in which the arm 62 is rotated, the external shape of the photosensor 80*a* is arranged to partly overlap the external shape of the photosensor 80*b*. Thus, a shadow of the external shape of the photosensor 80*a* projected in the radial direction overlaps a shadow of the external shape of the photosensor 80*b* projected in the radial direction. A region S1 is the region where the external shape of the photosensor 80*a* partly overlaps the external shape of the photosensor 80*b* in the movement direction of the arm 62. The reason is as follows. If the photosensors 80*a* and 80*b* are arranged in a straight line, the fine detection finer than the size of external shapes of the photosensors 80*a* and 80*b* cannot be performed. If the external shapes of the photosensors 80*a* and 80*b* are arranged to partly overlap each other, the finer detection can be achieved. Similarly, in the circumferential direction in which the arm 62 is rotated, regions S2 to S4 are formed. The region S2 is the region where the photosensor 80*b* partly overlaps the photosensor 80*c*, the region S3 is the region where the photosensor 80*c* partly overlaps the photosensor 80*d*, and the region S4 is the region where the photosensor 80*d* partly overlaps the photosensor 80*e*. In other words, in the circumferential direction in which the arm 62 is rotated, the arrangement interval between adjacent ones of the photosensors 80*a* to 80*e* is narrower than the size of the external shape of photosensors 80*a* to 80*e*.

According to the present exemplary embodiment, the regions S1, S2, S3, and S4 that partly overlap each other are formed. In the circumferential direction, the arrangement interval between adjacent ones of photosensors 80*a* to 80*e* is narrower than the size of the external shape of the photosensors 80*a* to 80*e*. However, the present invention is not limited to the configuration. For example, the arrangement interval between adjacent ones of the photosensors 80*a* to 80*e* can require a predetermined interval larger than the size of the external shape of the photosensors 80*a* to 80*e* according to the size of an attachment tool of the photosensors 80*a* to 80*e* or the space necessary for an attachment operation. The present invention may be applied to the configuration where, in the circumferential direction, an interval between adjacent ones of the photosensors 80*a* and 80*b* is larger than the external shape of the photosensors 80*a* and 80*b*.

As a fine detection method with a configuration where the photosensors 80*a* to 80*e* are arranged in a straight line, the photosensors 80*a* to 80*e* and the projections 62*c* and 62*d* can be kept away from the rotary center 62*b* of the arm 62. However, in this case, centrifugal force generated to the arm 62 is increased due to the weight of the projections 62*c* and 62*d*. As a result, there is a possibility that the arm 62 cannot follow the movement of the intermediate transfer belt 2. According to the present exemplary embodiment, the increase in distance between the projections 62*c* and 62*d* and the rotary center 62*b* of the arm 62 is suppressed. This thereby suppresses a decrease in followability of the arm 62 relative to the movement of the intermediate transfer belt 2.

FIG. 6 illustrates a relationship between the combination of the on-state and the off-state of the photosensors 80*a* to 80*e* and the position of the intermediate transfer belt 2 in the width direction. A white circle indicates the on-state, and a black circle indicates the off-state. A position number (No.) indicates the position of the intermediate transfer belt 2 in the width direction. As the position No. is larger, the intermediate transfer belt 2 is positioned nearer the first side, on which the driving roller 70 is arranged, in the width direction. If the position No. is different by 1, this means that the position of the intermediate transfer belt 2 deviates by 1 mm in the width direction. More particularly, at position No. 0, the intermediate transfer belt 2 greatly deviates to the second side in the width direction. At this time, all the photosensors 80*a*, 80*b*, 80*c*, 80*d*, and 80*e* are in the on-state. Position No. 1 deviates to the first side from position No. 0 by 1 mm in the width direction. At this time, the photosensors 80*a*, 80*b*, 80*c*, and 80*d* are in the on-state, and the photosensor 80*e* is in the off-state. The position No. 2 deviates to the first side from the position No. 1 by 1 mm in the width direction. At this time, the photosensors 80*a*, 80*b*, and 80*c* are in the on-state, and the photosensors 80*d* and 80*e* are in the off-state. Position No. 3 deviates to the first side from the position No. 2 by 1 mm in the width direction. At this time, the photosensors 80*a* and 80*b* are in the on-state, and the photosensors 80*c*, 80*d*, and 80*e* are in the off-state. Position No. 4 deviates to the first side from the position No. 3 by 1 mm in the width direction. At this time, the photosensor 80*a* is in the on-state, and the photosensors 80*b*, 80*c*, 80*d*, and 80*e* are in the off-state. With respect to the position Nos. 5, 6, 7, 8, and 9, the combination of the on-state and the off-state thereof is similarly changed.

Between the position Nos. 4 and 5, the intermediate transfer belt 2 is at a home position in the center in the width direction. If the intermediate transfer belt 2 is at the position Nos. 4, 3, and 2, the intermediate transfer belt 2 can desirably be returned to the home position in the width direction. Then, the steering motor 61 is controlled to move the end of the driving roller 26 in the direction H2. As the position of the intermediate transfer belt 2 is sequentially changed to the position Nos. 4, 3, and 2, the steering motor 61 is controlled to further move the end of the driving roller 26 in the direction H2. In other words, as the deviation amount of the intermediate transfer belt 2 is larger with the sequential change in position of the intermediate transfer belt 2 to the position Nos. 4, 3, and 2, the inclination of the driving roller 26 is increased and force of recovering the deviation is thus strengthened. If the intermediate transfer belt 2 is at the position Nos. 5, 6, and 7, the intermediate transfer belt 2 can desirably be returned to the home position. The steering motor 61 is controlled to move the end of the driving roller 26 in the direction H1. As the position of the intermediate transfer belt 2 is sequentially changed to the position Nos. 5, 6, and 7, the steering motor 61 is controlled to further move the end of the driving roller 26 in the direction H1. In other words, as the deviation amount of the intermediate transfer belt 2 is larger with the sequential change in position of the intermediate transfer belt 2 to the position Nos. 5, 6, and 7, the inclination of the intermediate transfer belt 2 is increased and force of recovering the deviation of the intermediate transfer belt 2 is thus strengthened. If the intermediate transfer belt 2 is at the position Nos. 1 and 8, the deviation amount of the intermediate transfer belt 2 is larger. Therefore, the image forming apparatus is suspended. Further, if the deviation amount of the intermediate transfer belt 2 further increases and the intermediate transfer belt 2 is at the position Nos. 0 and 9, the image forming apparatus outputs an error message.

According to the present exemplary embodiment, the position of the intermediate transfer belt 2 is finely detected, and the steering control is further finely performed. As a result, the deviation of the intermediate transfer belt 2 to the end thereof can be recovered without delay. Also, with the fine steering control, the deviation of the image position can be prevented.

According to the present exemplary embodiment, the arm 62 and the photosensors 80*a*, 80*b*, 80*c*, 80*d*, and 80*e* are fixed to the second frame 40. Therefore, if the driving roller 26 is inclined and the position of the end of the intermediate transfer belt 2 is thus moved, the positional relationship between the arm 62 and the end of the intermediate transfer belt 2 is not greatly changed. This can suppress a decrease in accuracy for detecting the position of the intermediate transfer belt 2 even if the end of the intermediate transfer belt 2 is bent.

Further, the contact roller 62*a* of the arm 62 comes into contact with the end of the intermediate transfer belt 2 near the driving roller 26, on the upstream side of the driving roller 26 in the movement direction of the intermediate transfer belt 2. Therefore, at the contact position of the contact roller 62*a*, the edge of the intermediate transfer belt 2 is stable without a flap, thereby suppressing an error increase in detecting the position of the intermediate transfer belt 2.

According to the present exemplary embodiment, the arm 62 is rotated. However, the present invention is not limited to this configuration. Alternatively, the arm 62 can be slid.

Figure 7:
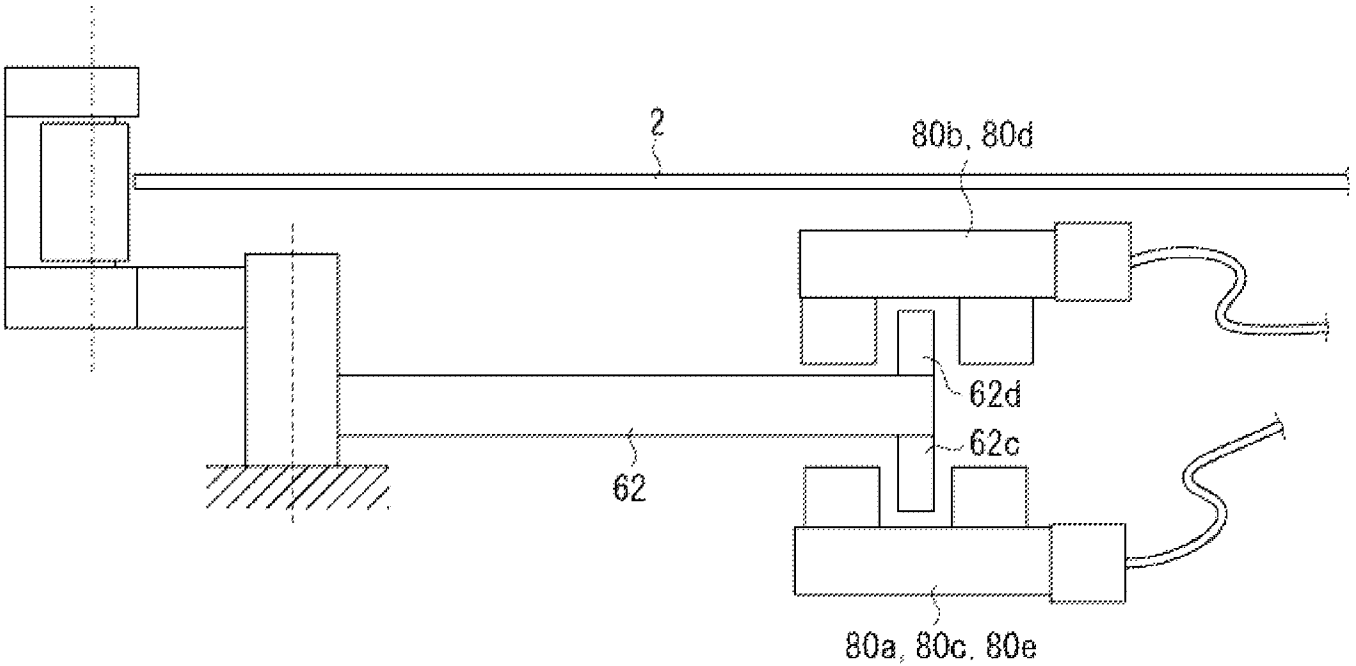
FIG. 7 illustrates an explanatory diagram of a belt detection device according to another exemplary embodiment of the present invention.
Figure 8:
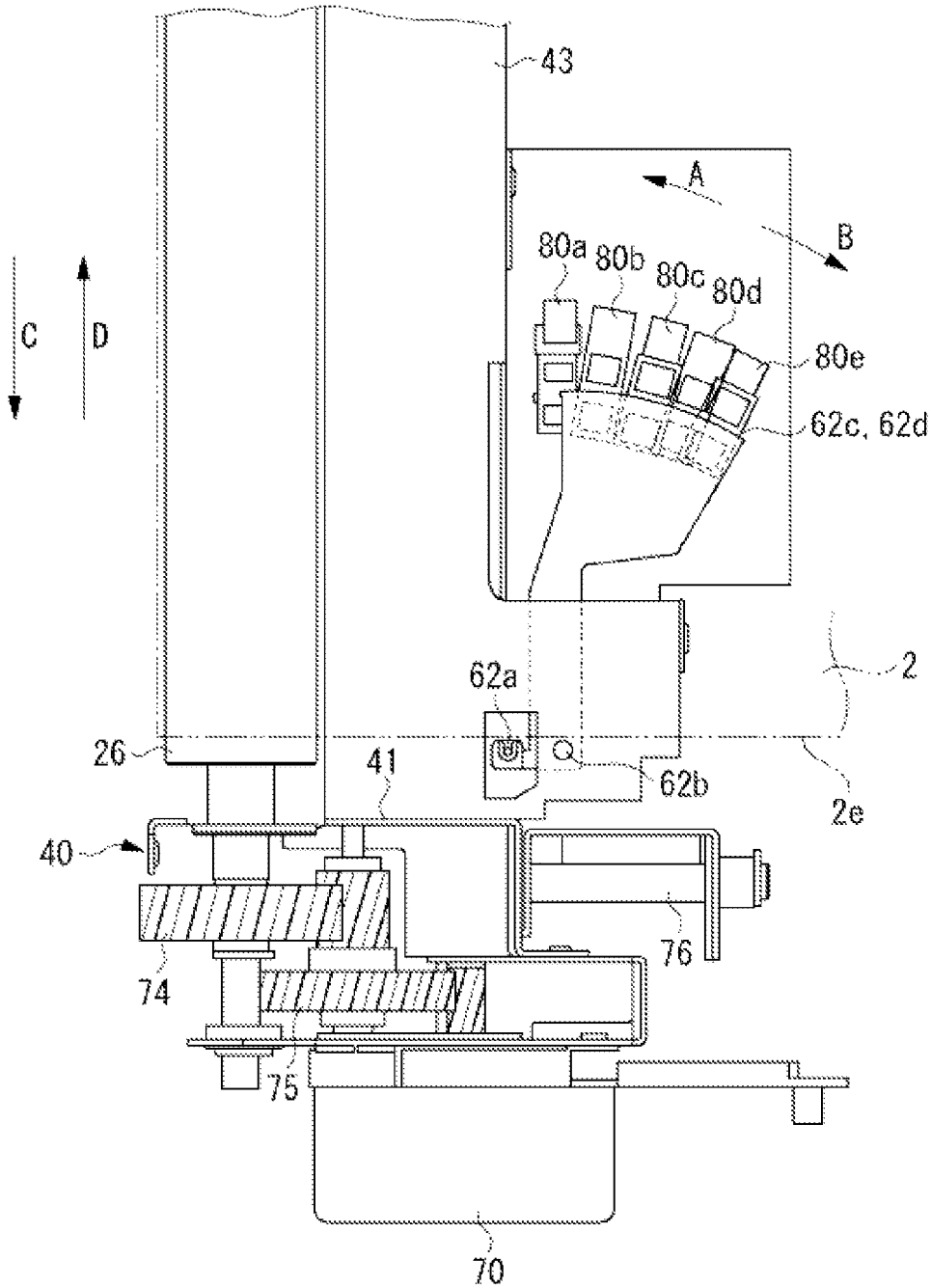
FIG. 8 illustrates another explanatory diagram of the belt detection device according to another exemplary embodiment.

According to the first exemplary embodiment, the projection 62*d* is disposed on the surface on the same side of the surface on which the projection 62*c* is arranged on the arm 62. Further, the projection 62*d* is disposed in the position different from that of the projection 62*c* in the radial direction vertical to the circumferential direction in which the arm 62 is rotated. However, the present invention is not limited to this configuration. As illustrated in FIGS. 7 and 8, there may be a configuration that the projection 62*d* is provided on a surface (second detected portion) on the opposite side of the surface on which the projection 62*c* is arranged on the arm 62, and the projection 62*d* is disposed in a position different from that of the projection 62*c* in the vertical direction of the arm surface.

In this case, as illustrated in FIGS. 7 and 8, a shadow of the projection 62*c* projected in the vertical direction overlaps a shadow of the projection 62*d* projected in the vertical direction. In the circumferential direction in which the arm 62 is rotated, the photosensor 80*b* is arranged between the photosensors 80*a* and 80*c*. In the circumferential direction in which the arm 62 is rotated, the photosensor 80*d* is arranged between the photosensors 80*c* and 80*e*. The photosensors 80*a*, 80*c*, and 80*e* detect the projection 62*c*, and the photosensors 80*b* and 80*d* detect the projection 62*d*.

When the arm 62 is moved in a direction A, the on-state and the off-state of the photosensors 80*a* to 80*e* are sequentially switched in order of the photosensors 80*e*, 80*d*, 80*c*, 80*b*, and 80*a*, and the position of the arm 62 is determined. On the other hand, when the arm 62 is moved in a direction B, the on-state and the off-state of the photosensors 80*a* to 80*e* are sequentially switched in order of the photosensors 80*a*, 80*b*, 80*c*, 80*d*, and 80*e*, and the position of the arm 62 is determined. With this configuration, there is a merit to save space necessary for arranging the photosensors 80*a* to 80*e* in the radial direction vertical to the rotational direction of the arm 62.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2011-232037 filed Oct. 21, 2011, which is hereby incorporated by reference herein in its entirety.

What is claimed is:

1. A belt member driving device comprising:

a movable belt member;

a tension roller configured to stretch the belt member;

a driving source configured to drive the belt member;

a steering roller configured to stretch the belt member and to be able to incline relative to the tension roller to move the belt member being driven in a width direction of the belt member;

an arm configured to be movable with movement of the belt member in the width direction thereof while being in contact with an end of the belt member in the width direction thereof;

a first detected portion provided on the arm;

a second detected portion provided on the arm and disposed in a position different from that of the first detected portion in a direction perpendicular to a movement direction of the arm on a plane where the arm is moved;

a first sensor configured to detect the first detected portion;

a second sensor configured to detect the first detected portion, wherein the second sensor is disposed in a position different from that of the first sensor in the movement direction of the arm as viewed in a direction perpendicular to the movement direction of the arm;

a third sensor configured to detect the second detected portion, wherein the third sensor is disposed between the first sensor and the second sensor in the movement direction of the arm as viewed in a direction perpendicular to the movement direction of the arm; and a control unit configured to control inclination of steering roller based on detection results by the first sensor, the second sensor, and the third sensor.

2. The belt member driving device according to claim 1, wherein the arm includes a rotary center, and wherein the third sensor is disposed between the first sensor and the second sensor in a circumferential direction in which the arm is rotated as viewed from the rotary center.

3. The belt member driving device according to claim 1, wherein the first detected portion and the second detected portion have projected shapes.

4. The belt member driving device according to claim 3, wherein each of the first sensor, the second sensor, and the third sensor is a photo-interrupter.

5. The belt member driving device according to claim 1, wherein, with respect to the movement direction of the arm, a gap between an outer frame of the first sensor and that of the second sensor is smaller than a length of an outer frame of the third sensor.

6. A belt member driving device comprising:

a movable belt member;

a tension roller configured to stretch the belt member;

a driving source configured to drive the belt member;

a steering roller configured to stretch the belt member and to be able to incline relative to the tension roller to move the belt member being driven in a width direction of the belt member;

an arm configured to be movable with movement of the belt member in the width direction thereof while being in contact with an end of the belt member in the width direction thereof, wherein the arm includes a first surface and a second surface as a rear surface side of the first surface;

a first detected portion provided on the arm;

a second detected portion provided on the second surface of the arm;

a first sensor configured to detect the first detected portion;

a second sensor configured to detect the second detected portion, wherein the second sensor and the first sensor partly overlap each other as viewed in a direction perpendicular to a plane where the arm is moved; and a control unit configured to control inclination of the steering roller based on detection results by the first sensor and the second sensor.

7. An image forming apparatus comprising:

the belt driving device according to claim 1;

a toner image forming unit configured to form a toner image on the belt member; and a transfer portion configured to transfer the toner image to a recording material from the belt member on which the toner image is formed.

8. An image forming apparatus comprising:

the belt driving device according to claim 6;

a toner image forming unit configured to form a toner image on the belt member; and a transfer portion configured to transfer the toner image to a recording material from the belt member on which the toner image is formed.

9. The belt member driving device according to claim 6, wherein the first detected portion and the second detected portion have projected shapes.

10. The belt member driving device according to claim 9, wherein each of the first sensor and the second sensor is a photo-interrupter.

* * * * *